US010919695B2

(12) United States Patent
Chandler

(10) Patent No.: US 10,919,695 B2
(45) Date of Patent: Feb. 16, 2021

(54) STAKE CABLING SYSTEM FOR SECURING BINS

(71) Applicant: Christopher Chandler, Washington, DC (US)

(72) Inventor: Christopher Chandler, Washington, DC (US)

(73) Assignee: Securecan Corporation, Washington, DC (US)

( * ) Notice: Subject to any disclaimer, the term of this patent is extended or adjusted under 35 U.S.C. 154(b) by 84 days.

(21) Appl. No.: 16/393,100

(22) Filed: Apr. 24, 2019

(65) Prior Publication Data

US 2019/0329976 A1 Oct. 31, 2019

Related U.S. Application Data

(60) Provisional application No. 62/662,450, filed on Apr. 25, 2018.

(51) Int. Cl.
*B65F 1/14* (2006.01)
*B65F 1/16* (2006.01)

(52) U.S. Cl.
CPC ..... *B65F 1/141* (2013.01); *B65F 1/1473* (2013.01); *B65F 1/16* (2013.01)

(58) Field of Classification Search
CPC ..... B65F 1/141; B65F 1/1615; E02D 5/803
USPC ..... 248/499, 907
See application file for complete search history.

(56) References Cited

U.S. PATENT DOCUMENTS 1,015,611 A * 1/1912 Bowen ..... E02D 5/803 52/161
1,764,813 A * 6/1930 Thornley ..... F16B 45/02 24/582.11
2,033,766 A * 3/1936 Hall ..... B60C 27/08 24/600.9
2,193,291 A * 3/1940 Marchins ..... F16G 15/08 59/95
2,448,456 A * 8/1948 Niskanen ..... 211/85.19
2,545,320 A * 3/1951 Tilson ..... B65F 1/141 248/346.03
3,980,202 A * 9/1976 Monyak ..... B65D 45/00 220/318
4,308,683 A * 1/1982 Lee ..... A01M 23/245 248/156
4,487,537 A * 12/1984 Morse ..... B60P 7/12 24/115 H
4,559,747 A * 12/1985 Engel ..... B65F 1/141 248/907
4,727,694 A * 3/1988 Rockenfeller ..... E02D 5/803 52/163
5,515,656 A * 5/1996 Mihalich ..... B64F 1/12 248/156
5,887,834 A * 3/1999 Gellos ..... B65F 1/1615 248/156

(Continued)

*Primary Examiner* — Bradley Duckworth
(74) *Attorney, Agent, or Firm* — Dunlap Bennett & Ludwig, PLLC

(57) ABSTRACT

A stake-cable system for securing wheeled trash bins and lids thereof is provided. The stake-cable system includes a cable connecting an object attachment point associated with the bin or lid and an anchor attachment point affixed to or adjacent to the ground. The stake-cable system also includes quick-release interconnectors between the attachment points and the cable, which may terminate in opposing loops to facilitate such quick-release interconnections.

7 Claims, 5 Drawing Sheets

(56) References Cited

U.S. PATENT DOCUMENTS

| | | | | |
|---|---|---|---|---|
| 6,308,385 | B1 * | 10/2001 | Ball | A44C 5/2033 24/375 |
| 7,175,149 | B2 * | 2/2007 | Gallien | A47B 97/00 248/499 |
| 7,654,407 | B1 * | 2/2010 | Obrecht | B65F 1/141 220/475 |
| 8,353,653 | B2 * | 1/2013 | Guthrie | A63B 29/024 411/344 |
| 9,376,781 | B2 * | 6/2016 | Staller | E05G 1/005 |
| D769,104 | S * | 10/2016 | Reid | D8/356 |
| 9,850,065 | B2 * | 12/2017 | Decker | B65F 1/141 |
| 10,221,011 | B2 * | 3/2019 | Stone | B65F 1/1646 |
| 10,352,064 | B2 * | 7/2019 | Gilmer | E04H 15/62 |
| 2006/0151504 | A1 * | 7/2006 | Garvie | B65F 1/141 220/475 |
| 2007/0175900 | A1 * | 8/2007 | Richardson | B65F 1/141 220/484 |
| 2009/0032671 | A1 * | 2/2009 | Perry | B61D 45/001 248/499 |
| 2012/0181816 | A1 * | 7/2012 | Jutila | B60P 7/0807 296/183.1 |
| 2014/0325805 | A1 * | 11/2014 | Troiano | E05C 1/04 24/600.5 |
| 2018/0056134 | A1 * | 3/2018 | Chu | A62B 35/0037 |

* cited by examiner

STAKE CABLING SYSTEM FOR SECURING BINS

CROSS-REFERENCE TO RELATED APPLICATION

This application claims the benefit of priority of U.S. provisional application No. 62/662,450, filed 25 Apr. 2018 the contents of which are herein incorporated by reference.

BACKGROUND OF THE INVENTION

The present invention relates to bin securement systems and, more particularly, to a stake-cable system for securing wheeled trash bins and lids thereof.

During high winds plastic trash bins on wheels and trash bin lids tend to roll or fly away down the street or alley way. Retrieving such bins and lids can be an annoyance. Also, the far-flung articles can result in property damage and cause an accident, which the owner may be liable for. For all trash bins having attached lids that raise open, rodents, critters and human dumpster-divers can open the lids and gain excess to the contents of the bin, strewing garbage everywhere that the owner is responsible for cleaning up.

As can be seen, there is a need for a stake-cable system for securing wheeled trash bins and lids thereof. The present invention embodies a system of attaching stakes to the ground and provides added protection to secure the trash bins without penetration of a building structure (which could damage the building or its façade, as well as limit the placement of the system—i.e., far away from the garbage pick-up point). Where applicable, staking to the ground avails users to the strength of concrete fill without the concern of damaging their house or building. Furthermore, ground-staking affords users the ability to locate the staked in a lot more places than if it were staked to a building. The present invention contemplates secondary staking locations along the supporting surface for moving the trash bin between pick-up and storage locations. The present invention also embodies a quick release mechanism so that the bin can easily be repositioned between such locations. The Stake cabling system is a DIY light duty retainer system not intended to be used in extreme weather conditions such as hurricanes. Depending on conditions, a Heavy-Duty version can be created which may be more appropriate. The Stake grounding system should not be used in such a way that installation or engagement could cause injury or property damage.

SUMMARY OF THE INVENTION

In one aspect of the present invention, a stake-cable system for trash bins, includes the following: an object attachment point associated with a trash bin; an anchor attachment point associated with a ground surface; a cable connecting the object and anchor attachment points; and one or more interconnectors interconnecting one or both ends of their respective attachment points.

In another aspect of the present invention, the stake-cable system for trash bins includes the following: an object attachment point associated with a trash bin, wherein the object attachment point is a cross bar integrated to the trash bin or is a lid hook integrated to a lid of the trash bin; an anchor attachment point associated with a ground surface; the anchor attachment comprising: an anchor post extending between an eye hole and a toggle bolt anchor, wherein the toggle bolt anchor operatively associates with the supporting surface in an extended condition, and wherein the eye hole operatively associates with either the cable or one of the one or more interconnectors; an O-ring removably engaging the toggle bolt anchor in a contracted condition; a cable connecting the object and anchor attachment points, wherein the cable terminates in opposing loops secured by a lock stop; and one or more interconnectors, interconnecting one or both ends of their respective attachment points.

In yet another aspect of the present invention, a method of securing a trash bin includes the following: providing the above-mentioned stake-cable system for trash bins; drilling a hole in the ground surface; lowering the anchor attachment point, toggle bolt anchor first, into said hole so that the eye hole protrudes above the ground surface; using a removal tool for disengaging the O-ring so that the toggle bolt anchor moves to the extended condition; filling said hole with a cementitious material; after the cementitious material hardens, connecting the cable between the eye hole and one of the one or more interconnectors; and interconnecting said interconnector to the object attachment point.

In yet another aspect of the present invention, a carabiner includes the following: a carabiner frame having a 3-shape; the carabiner frame defining two opposing securement spaces; each securement space is accessible through an opening; and each opening providing a gate movable between an open position and a closed condition by pivoting in a base opening in the carabiner frame, wherein each gate is spring-biased in the closed position wherein a distal end of said gate engages a distal end of the carabiner frame.

These and other features, aspects and advantages of the present invention will become better understood with reference to the following drawings, description and claims.

DETAILED DESCRIPTION OF THE INVENTION

Figure 1:
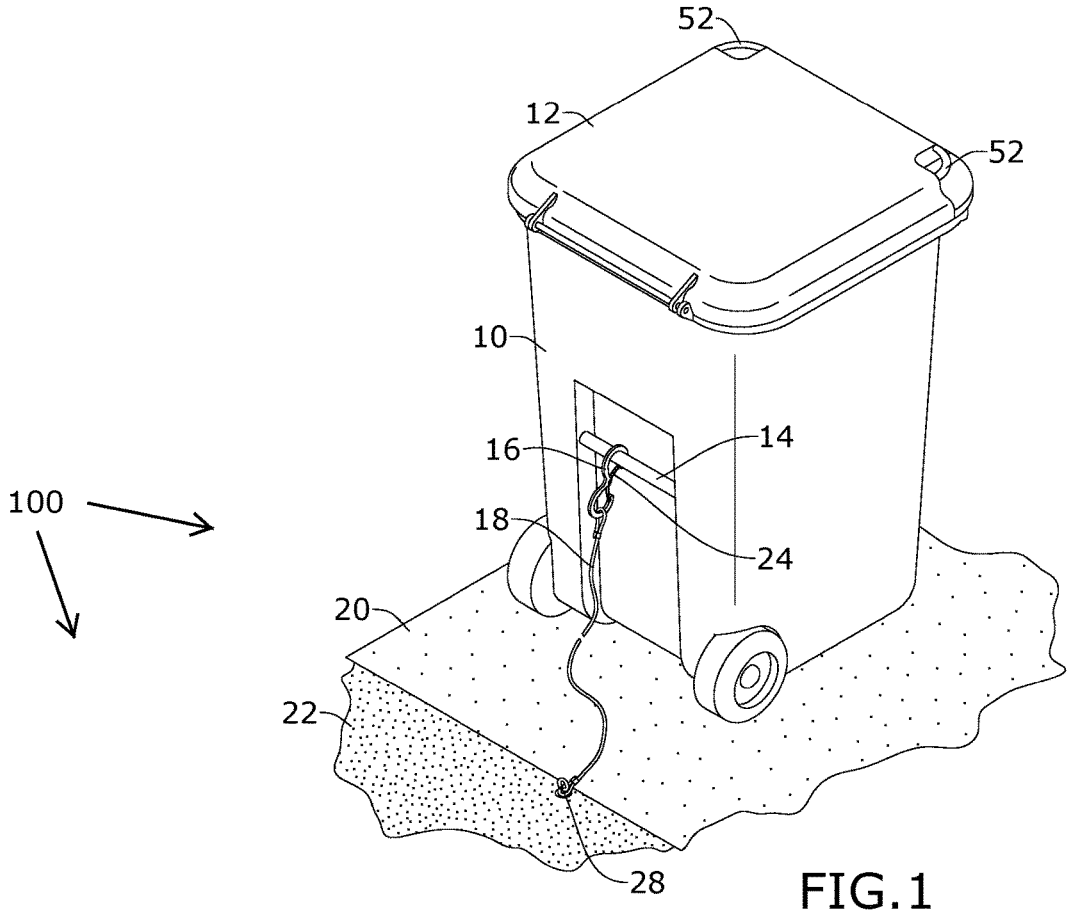
FIG. 1 is a perspective view of an exemplary embodiment of the present invention.
Figure 2:
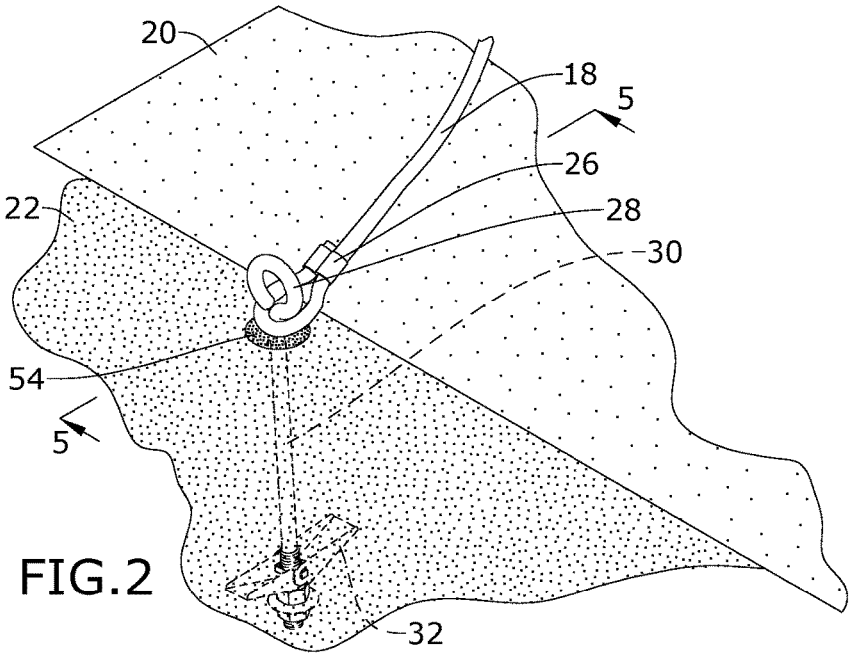
FIG. 2 is a detailed perspective view of an exemplary embodiment of the present invention.
Figure 3:
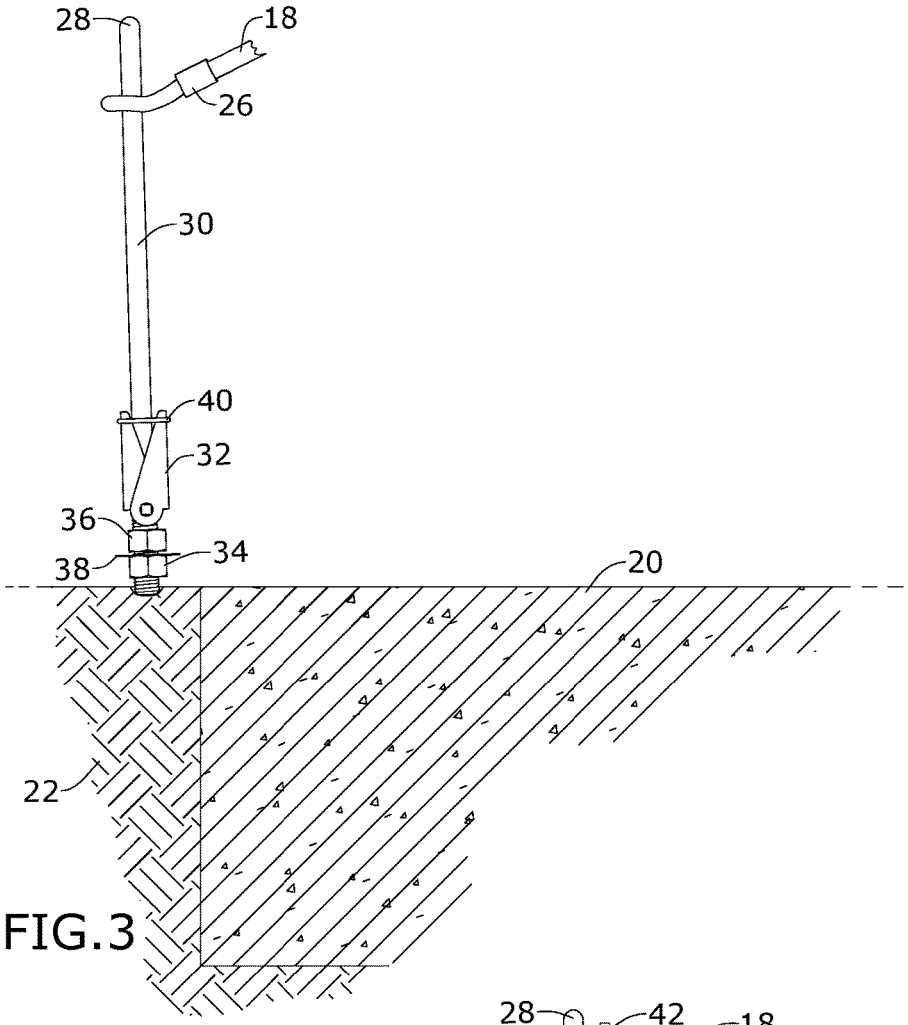
FIG. 3 is a detailed perspective view of an exemplary embodiment of the present invention.
Figure 4:
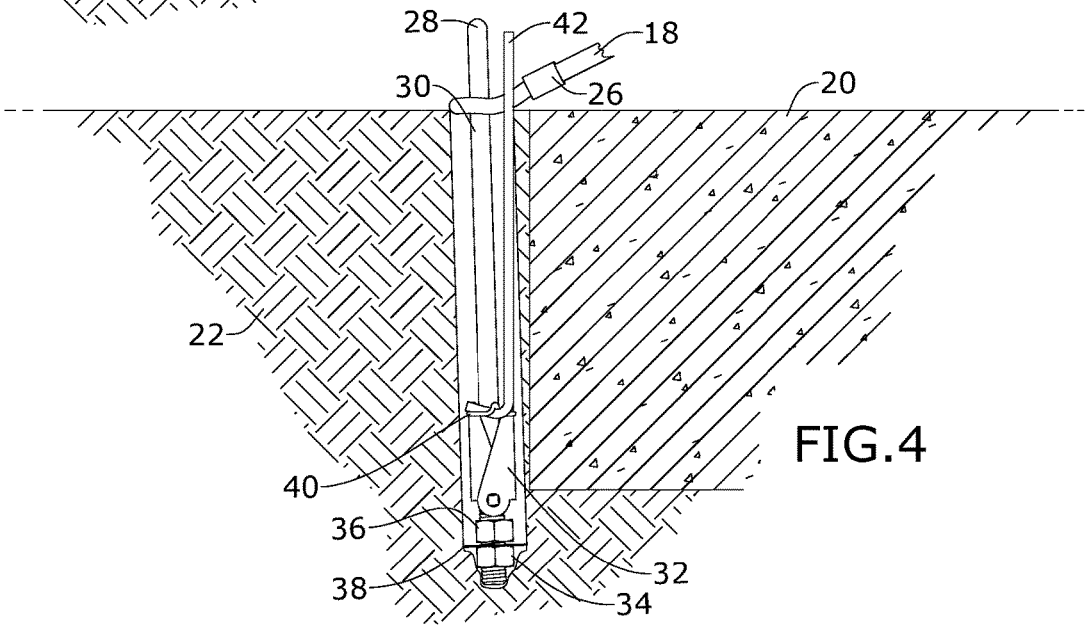
FIG. 4 is a section view of an exemplary embodiment of the present invention, illustrating O-ring removal.
Figure 5:
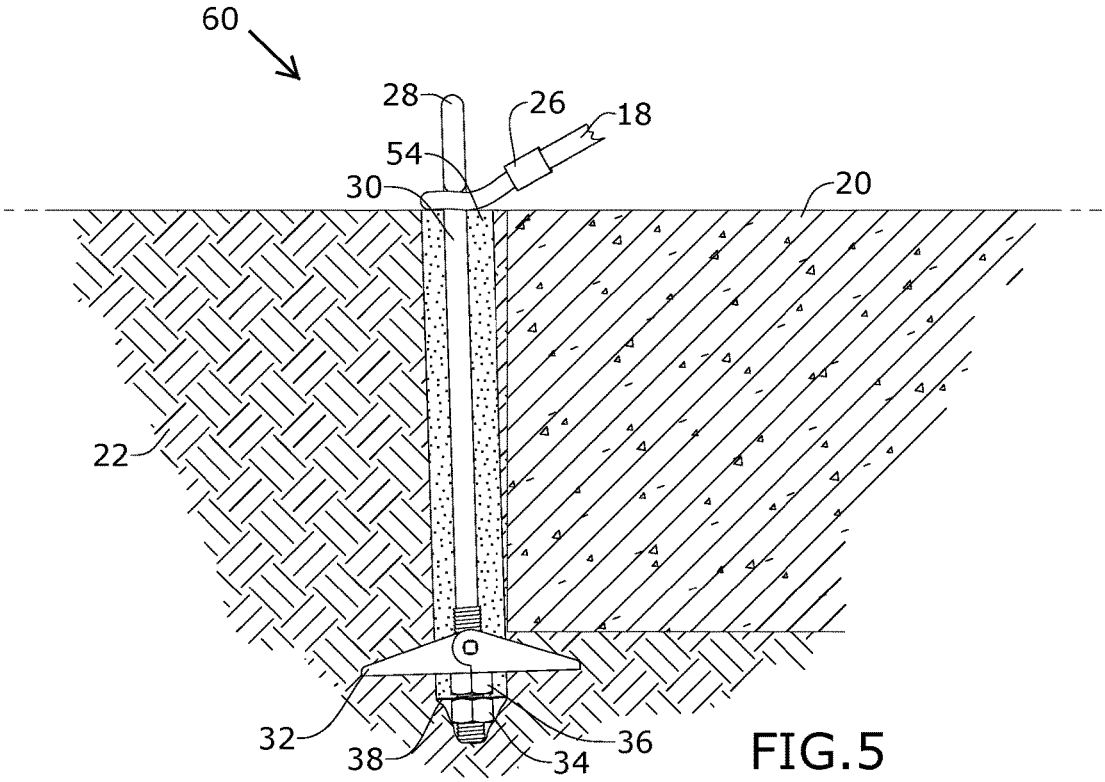
FIG. 5 is a section view of an exemplary embodiment of the present invention, taken along line 5-5 of FIG. 2.
Figure 6A:
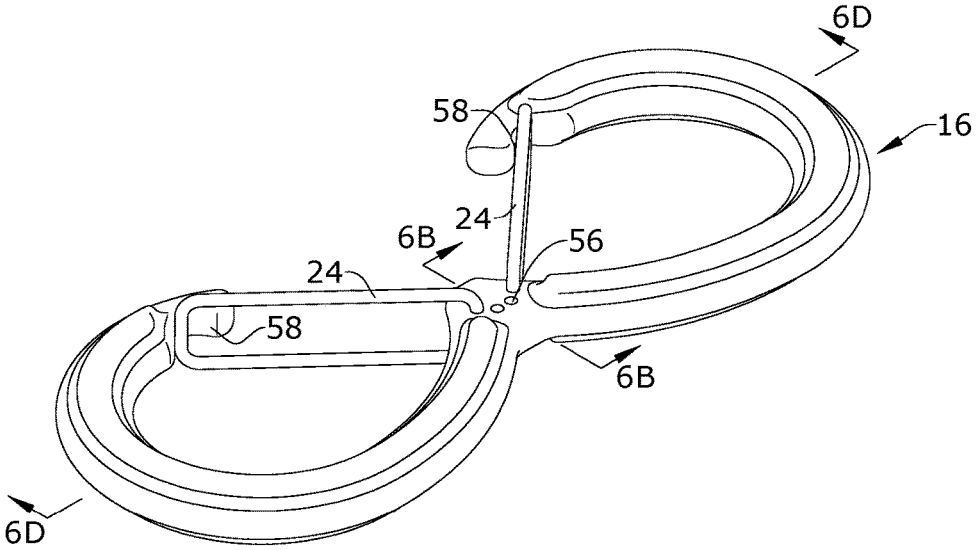
FIG. 6A is a perspective view of an exemplary embodiment of a first interconnector of the present invention.
Figure 6B:
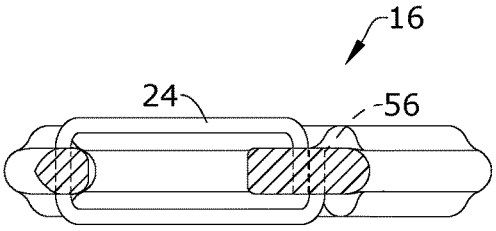
FIG. 6B is a section view of an exemplary embodiment of the present invention, taken along line 6B-6B of FIG. 6A.
Figure 6C:
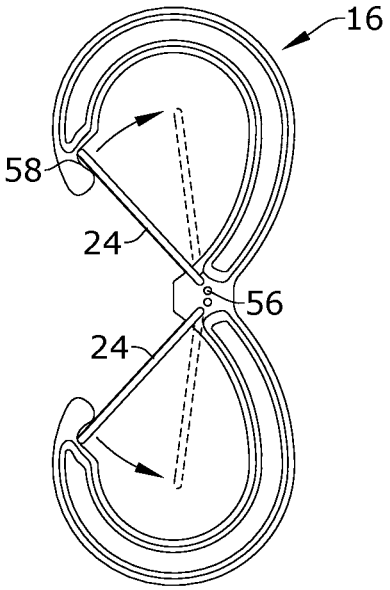
FIG. 6C is a top view of an exemplary embodiment of the first interconnector of the present invention.
Figure 6D:
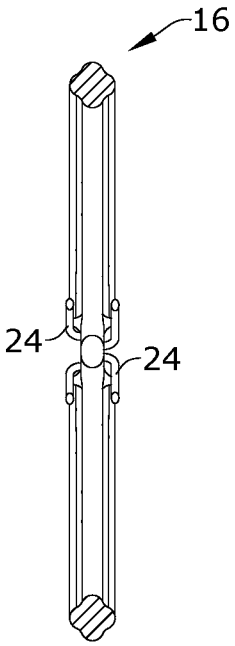
FIG. 6D is a section view of an exemplary embodiment of the first interconnector of the present invention, taken along line 6D-6D of FIG. 6A.
Figure 6E:
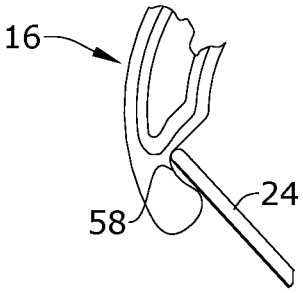
FIG. 6E is a detailed perspective view of an exemplary embodiment of the first interconnector of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a stake-cable system for securing wheeled trash bins and lids thereof. The system includes a cable connecting an object attachment point associated with the bin or lid and an anchor attachment point affixed to or adjacent to the ground. The system also includes quick-release interconnectors between the attachment points and the cable, which may terminate in opposing loops to facilitate such quick-release interconnections.

Referring to FIGS. 1 through 10, the present invention may include a stake-cable system 100 for securing wheeled trash bins 10 and lids 12 thereof. The stake-cable system 100 may include a cable 18 connecting an anchor attachment point 60 and an object attachment point 70 of the trash bins 10 or the lid 12 thereof. Interconnecting the cable and the attachment points 60 and 70 may be easy-release interconnectors 16, 46 and 48. The cable 18 may be a plastic-covered wire cable or other sufficient strong tension element, wherein the plastic is heat resistant. Adjacent one or both ends of the cable 18 may be a lock stop 26 provided to support a loop in the cable 18 for the connection between the cable 18 and the anchor and/or object attachment point 60/70 and/or interconnectors 16, 46 and 48.

Such a clamped cable loop provides the ability to connect the two quick release interconnectors 16, 46, 48 at opposite ends of the cable 18, which attaches to the object attachment point 70 and to the anchor attachment point 70. The object attachment points 70 may be a cross bar 14 of the trash bin 10, a lid hook 52 of the lid 12, or the like. The anchor attachment points 60 may be anchor fixed in the ground 22 or adjacent thereto, for example an anchored attached to a column 50 fixed to the ground 22.

Referring to FIGS. 6A through 6E. the present invention, in certain embodiments, includes a first interconnector 16. The first interconnector 16 may be a m/3 carabiner providing two opposing securement spaces, each securement space accessible through an opening gated by a spring-biased clip 24 which is movable between an open position and a closed condition by pivoting in a base opening 56. The spring-biased clip 24 is biased in the closed position wherein a distal end of the spring-biased clip 56 engages an arm support 58. The m/3 carabiner may be rated at approximately 50-75 lbs. If a stronger connector is required, it can be upgraded using specified metallic material to obtain the desired strength, depending on the conditions and intended use. The m/3 carabiner is designed for use in the stake cabling system to provide quick release of attached items so that services can be rented without delay.

Figure 7:
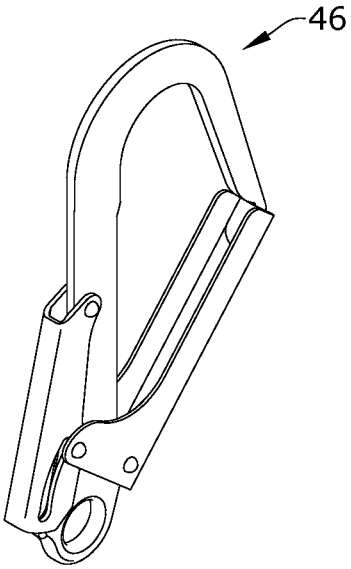
FIG. 7 is a perspective view of an exemplary embodiment of a second interconnector the present invention.
Figure 8:
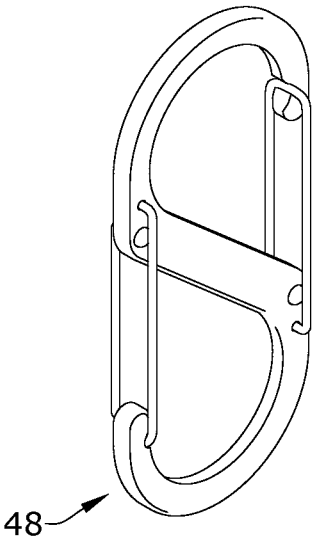
FIG. 8 is a perspective view of an exemplary embodiment of a third interconnector of the present invention.
Figure 9:
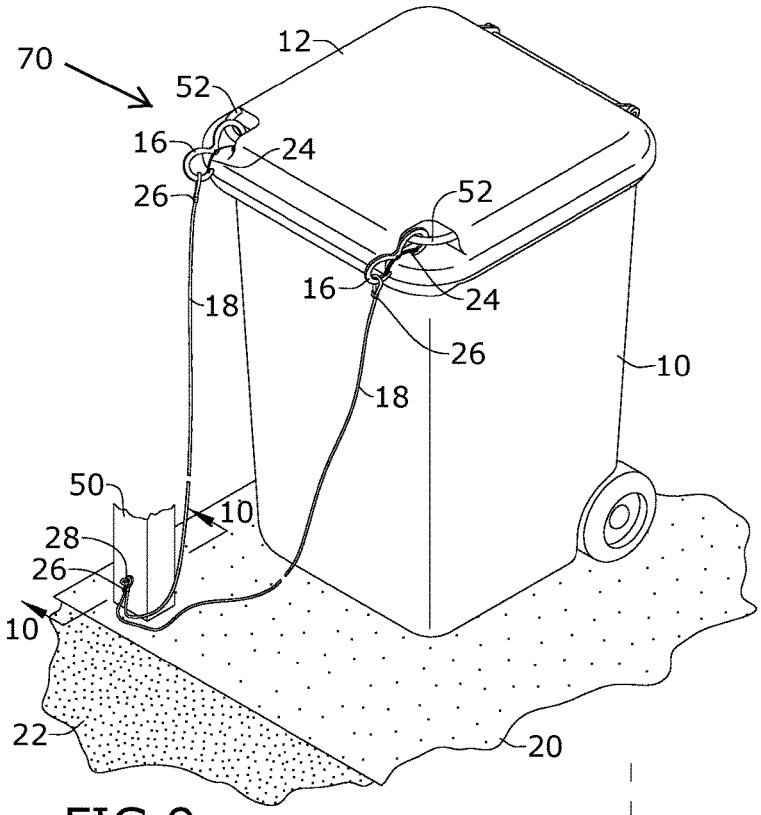
FIG. 9 is a perspective view of an exemplary embodiment of the present invention.
Figure 10:
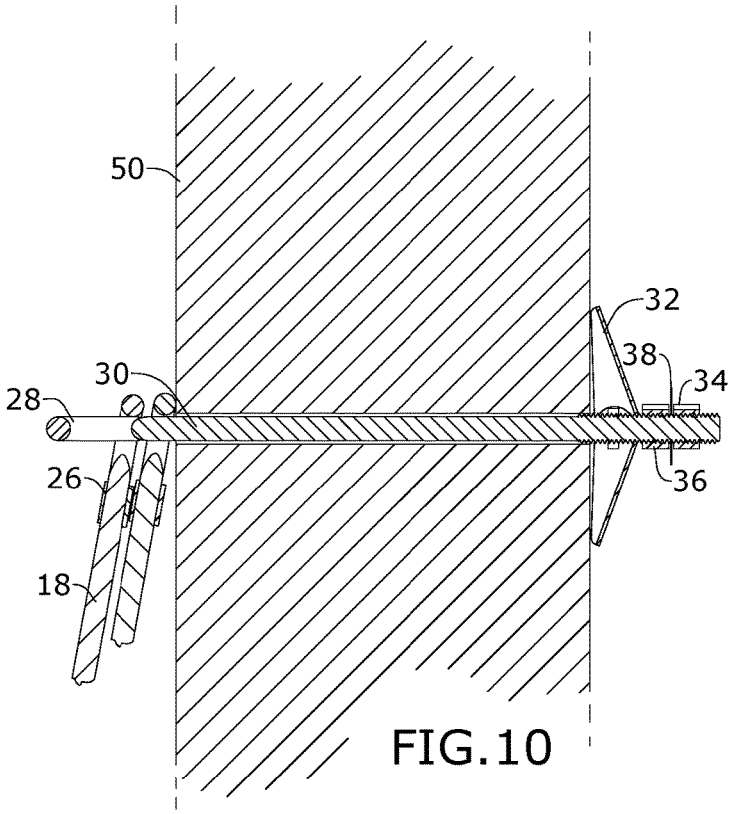
FIG. 10 is a section view of an exemplary embodiment of the present invention, taken along line 10-10 of FIG. 9.

Referring to FIGS. 7 and 8, the present invention, in certain embodiments, includes a second interconnector 46 and a third interconnector 48, which may be a scaffolding carabiner and a S-hook carabiner, respectively.

The anchor attachment points 60 may include an anchor post 30 terminating in an eye hole 28 on one end while along the opposing end of the anchor post 30 may be connected to toggle bolt anchor 32 secured by first connector 34 (e.g., a lower nut), a second connector 36 (e.g., an upper nut) and a third connector 38 (e.g., a spacing washer) so as to form a locked engagement with quick connect capability. The anchor post 30 may be eight to fourteen inches in length. An O-ring 40 may keep the toggle bolt anchor 32 in a contracted condition (illustrated in FIGS. 3 and 4), preventing the toggle bolt anchor 32 from biasing to an expanded condition (illustrated in FIGS. 5 and 10).

When installing the stake-cable system 100 in the ground 20, a user would most likely avoid connection to a pre-existing concrete pad 20 so as to avoid damage thereto and rather couple the anchor attachment point 60 to the ground 22. Wherein the user may drive the anchor post 30 into the ground 22 with a normal hammer and attach the quick interconnectors 16, 46, 48 to the bin 10 and the anchor eye hole 28. Alternatively, the user may drill a hole in the ground 22, insert into the hole the anchor post 30, toggle bolt anchor 32 first, wherein the toggle bolt anchor 32 is engaged by the O-ring in the contracted condition, fill said hole with cementitious material 54, and then use a removal tool 42 to disengage the O-ring 40, thereby moving the toggle bolt anchor 32 to the expanded condition.

When attaching to said column 50 the anchor post 30 may be drilled through, with the expanded toggle bolt anchor 32 and the eye hole 28 protruding from opposing sides of the column 50.

The user may place more than one anchor attachment point 60; for instance, putting one anchor attachment point 60 at a storage location for the trash bin 10 and the other attachment point 60 near where the service trash pick-up is, or two anchor attachment points 60 if they have two trash bins 10. More than one cable 18 can be provided so that the user never has to move one of the cables 18 between multiple anchor attachment points 60.

The user can position the stake-cable system 100 to secure only the lid 12. One may loop the cable 18 through the bin 10 to secure it while away (say, on vacation) so the movement is very little from the original spot. The use can put the cable 18 loop through the anchor eye hole 28 so it does not require a quick connecting interconnector 16, 46, 48; rather, the quick connecting interconnector 16, 46, 48; can be used to lock the lid down. The stake-cable system 100 can be used to secure anything one wants locked down so that it does not move, such as an outdoor tent, grills, small generators and other appliances. More over the present invention may lock onto a wheel bar, bin or lid to also help prevent tip over.

It should be understood, of course, that the foregoing relates to exemplary embodiments of the invention and that modifications may be made without departing from the spirit and scope of the invention as set forth in the following claims.

What is claimed is:

1. A stake-cable system for trash bins, comprising:

an object attachment point associated with a trash bin;

an anchor attachment point associated with a ground surface;

a cable connecting the object and anchor attachment points; and one or more interconnectors interconnect one or both ends of the cable to a respective attachment point, wherein the anchor attachment point further comprises an anchor post extending between an eye hole and a toggle bolt anchor, wherein the toggle bolt anchor is connected to the ground surface in an extended condition, and wherein the eye hole engages with either the cable or one of the one or more interconnectors;

an O-ring removably engaging the toggle bolt anchor in a contracted condition.

2. The stake-cable system for trash bins of claim 1, wherein the object attachment point is a cross bar integrated to the trash bin.

3. The stake-cable system for trash bins of claim 1, wherein the object attachment point is a lid hook integrated to a lid of the trash bin.

4. The stake-cable system for trash bins of claim 1, wherein the cable terminates in opposing loops secured by a lock stop, respectively.

5. The stake-cable system for trash bins of claim 1, wherein the one or more interconnectors are carabiners.

6. The stake-cable system for trash bins of claim 5, wherein each carabiner comprises:

a carabiner frame having a 3-shape;

the carabiner frame defining two opposing securement spaces;

each securement space is accessible through an opening; and each opening providing a gate movable between an open position and a closed condition by pivoting in a base opening in the carabiner frame, wherein each gate is spring-biased in the closed position wherein a distal end of said gate engages a distal end of the carabiner frame.

7. A method of securing a trash bin, comprising:

providing the stake-cable system for trash bins of claim 1;

drilling a hole in the ground surface;

lowering the anchor attachment point, toggle bolt anchor first, into said hole so that the eye hole protrudes above the ground surface;

using a removal tool for disengaging the O-ring so that the toggle bolt anchor moves to the extended condition;

filling said hole with a cementitious material;

after the cementitious material hardens, connecting the cable between the eye hole and one of the one or more interconnectors; and interconnecting said interconnector to the object attachment point.

* * * * *